US008836454B2

(12) United States Patent
Page et al.

(10) Patent No.: US 8,836,454 B2
(45) Date of Patent: Sep. 16, 2014

(54) MINIATURE MAGNETIC SWITCH STRUCTURES

(75) Inventors: William C. Page, Norcross, GA (US); Lawrence DiFrancesco, Colorado Springs, CO (US); Dain P. Bolling, Sebastian, FL (US); David P. Paturel, San Marino, CA (US)

(73) Assignee: Telepath Networks, Inc., Raleigh, NC (US)

( * ) Notice: Subject to any disclaimer, the term of this patent is extended or adjusted under 35 U.S.C. 154(b) by 151 days.

(21) Appl. No.: 12/607,865

(22) Filed: Oct. 28, 2009

(65) Prior Publication Data

US 2011/0037542 A1 Feb. 17, 2011

Related U.S. Application Data

(60) Provisional application No. 61/233,073, filed on Aug. 11, 2009.

(51) Int. Cl.

| | |
|---|---|
| ***H01H 51/22*** | (2006.01) |
| ***H01H 49/00*** | (2006.01) |
| *H01H 50/04* | (2006.01) |
| *H01F 7/06* | (2006.01) |

(52) U.S. Cl.

CPC ..... *H01H 50/043* (2013.01); *H01H 49/00* (2013.01); *H01H 2050/049* (2013.01); *H01F 2007/068* (2013.01)

USPC ..... 335/80; 335/78

(58) Field of Classification Search

USPC ..... 335/80, 203

See application file for complete search history.

(56) References Cited

U.S. PATENT DOCUMENTS

| | | | | |
|---|---|---|---|---|
| 5,329,520 | A | 7/1994 | Richardson | |
| 5,475,353 | A | 12/1995 | Roshen et al. | |
| 5,479,608 | A | 12/1995 | Richardson | |
| 5,552,756 | A * | 9/1996 | Ushiro | 336/200 |
| 5,629,918 | A | 5/1997 | Ho et al. | |
| 5,787,085 | A | 7/1998 | Fox | |
| 5,790,519 | A | 8/1998 | Hanson et al. | |
| 5,872,496 | A | 2/1999 | Asada et al. | |
| 5,982,746 | A | 11/1999 | Hanson et al. | |
| 6,016,092 | A | 1/2000 | Qiu et al. | |

(Continued)

FOREIGN PATENT DOCUMENTS

| | | |
|---|---|---|
| KR | 10-0474536 | 3/2005 |
| KR | 10-2006-0078097 | 7/2006 |
| KR | 10-2009-0053103 | 5/2009 |
| WO | WO 01/57899 A1 | 8/2001 |

OTHER PUBLICATIONS

Form PCT/ISA/210 in connection with PCT/US2010/042789 dated Feb. 25, 2011.

(Continued)

*Primary Examiner* — Shawki S Ismail
*Assistant Examiner* — Lisa Homza
(74) *Attorney, Agent, or Firm* — Greenburg Traurig, LLP; Franklin D. Ubell

(57) ABSTRACT

A switching device structure comprising a top magnet, a bottom magnet, and a movable member disposed between the top and bottom magnets, the movable member having an electromagnet positioned thereon, the electromagnet comprising a plurality of laminated layers, the layers including a layer bearing an iron core and a number of armature layers which establish electrical conductor windings around the iron core.

23 Claims, 12 Drawing Sheets

(56) References Cited

U.S. PATENT DOCUMENTS

| | | | | |
|---|---|---|---|---|
| 6,069,540 | A | 5/2000 | Berenz et al. | |
| 6,084,281 | A * | 7/2000 | Fullin et al. | 257/422 |
| 6,094,116 | A | 7/2000 | Tai et al. | |
| 6,169,469 | B1 | 1/2001 | Misumi et al. | |
| 6,310,426 | B1 * | 10/2001 | Birchak et al. | 310/335 |
| 6,310,526 | B1 | 10/2001 | Yip et al. | |
| 6,335,992 | B1 | 1/2002 | Bala et al. | |
| 6,388,359 | B1 | 5/2002 | Duelli et al. | |
| 6,469,602 | B2 | 10/2002 | Ruan et al. | |
| 6,469,603 | B1 | 10/2002 | Ruan et al. | |
| 6,472,074 | B2 * | 10/2002 | Sugimoto | 428/432 |
| 6,496,612 | B1 | 12/2002 | Ruan et al. | |
| 6,535,663 | B1 | 3/2003 | Chertkow | |
| 6,542,379 | B1 | 4/2003 | Lauffer et al. | |
| 6,633,212 | B1 * | 10/2003 | Ruan et al. | 335/78 |
| 6,639,493 | B2 | 10/2003 | Shen et al. | |
| 6,653,929 | B1 | 11/2003 | Hu et al. | |
| 6,710,694 | B2 * | 3/2004 | Matsuta et al. | 336/200 |
| 6,785,038 | B2 | 8/2004 | Hichwa et al. | |
| 6,794,965 | B2 | 9/2004 | Shen et al. | |
| 6,812,814 | B2 | 11/2004 | Ma et al. | |
| 6,904,191 | B2 | 6/2005 | Kubby | |
| 6,947,624 | B2 | 9/2005 | Kubby et al. | |
| 7,023,304 | B2 | 4/2006 | Shen et al. | |
| 7,027,682 | B2 | 4/2006 | Ruan et al. | |
| 7,071,431 | B2 | 7/2006 | Ruan et al. | |
| 7,142,743 | B2 | 11/2006 | Bernstein | |
| 7,193,831 | B2 * | 3/2007 | Anthony | 361/118 |
| 7,215,229 | B2 | 5/2007 | Shen et al. | |
| 7,266,867 | B2 | 9/2007 | Shen et al. | |
| 7,327,211 | B2 | 2/2008 | Ruan et al. | |
| 7,342,473 | B2 | 3/2008 | Joung et al. | |
| 8,143,978 | B2 | 3/2012 | Shen | |
| 2002/0140533 | A1 * | 10/2002 | Miyazaki et al. | 335/78 |
| 2003/0011450 | A1 | 1/2003 | Shen et al. | |
| 2003/0043003 | A1 | 3/2003 | Vollmers et al. | |
| 2003/0151480 | A1 * | 8/2003 | Orr | 335/78 |
| 2005/0047010 | A1 | 3/2005 | Ishiwata et al. | |
| 2005/0057329 | A1 * | 3/2005 | Shen et al. | 335/78 |
| 2005/0270127 | A1 | 12/2005 | Six | |
| 2010/0182111 | A1 * | 7/2010 | Hagihara et al. | 335/203 |
| 2010/0214044 | A1 | 8/2010 | Shen | |
| 2011/0037542 | A1 | 2/2011 | Page et al. | |
| 2012/0200377 | A1 | 8/2012 | Lee et al. | |

OTHER PUBLICATIONS

Form PCT/ISA/237 in connection with PCT/US2010/042789 dated Feb. 25, 2011.

Telepath Networks, Inc. et al., Form PCT/ISA/210 in connection with PCT/US2011/057907.

Telepath Networks, Inc. et al., Form PCT/ISA/237 in connection with PCT/US2011/057907.

* cited by examiner

MINIATURE MAGNETIC SWITCH STRUCTURES

CROSS REFERENCE TO RELATED APPLICATIONS

This application claims the benefit of and priority to U.S. Provisional Application Ser. No. 61/233,073, filed Aug. 11, 2009, entitled, "Miniature Magnetic Switch Structures," the contents of which is incorporated by reference herein in its entirety.

FIELD

The subject disclosure pertains to the field of switching devices and relays and more particularly to miniature switching devices fabricated from a number of laminated layers.

RELATED ART

Electromechanical and solid state switches and relays have long been known in the art. More recently, the art has focused on micro electromechanical systems (MEMS) technology.

SUMMARY

The following is a summary description of illustrative embodiments of the invention. It is provided as a preface to assist those skilled in the art to more rapidly assimilate the detailed design discussion which ensues and is not intended in any way to limit the scope of the claims which are appended hereto in order to particularly point out the invention.

According to an illustrative embodiment, a switching device structure is provided comprising a top magnet, a bottom magnet, and a movable member disposed between the top and bottom magnets. An electromagnet is positioned on the movable member.

In one embodiment, the electromagnet comprises a plurality of laminated layers, the layers including a layer bearing an iron core and a number of armature layers which establish electrical conductor windings around the iron core. The movable member further carries an electrical contact at one end positioned to close an electrical connection with a second electrical contact upon actuation of the electromagnet.

In one illustrative embodiment, the switching device structure further includes a first laminated layer located between the electromagnet and the top magnet comprising one or more posts of material suitable to channel magnetic forces from the top magnet toward the electromagnet, as well as a second laminated layer located between the electromagnet and the bottom magnet, the second laminated layer also comprising one or more posts of material suitable to channel magnetic forces from the bottom magnet toward the electromagnet.

DETAILED DESCRIPTION OF ILLUSTRATIVE EMBODIMENTS

Figure 1:
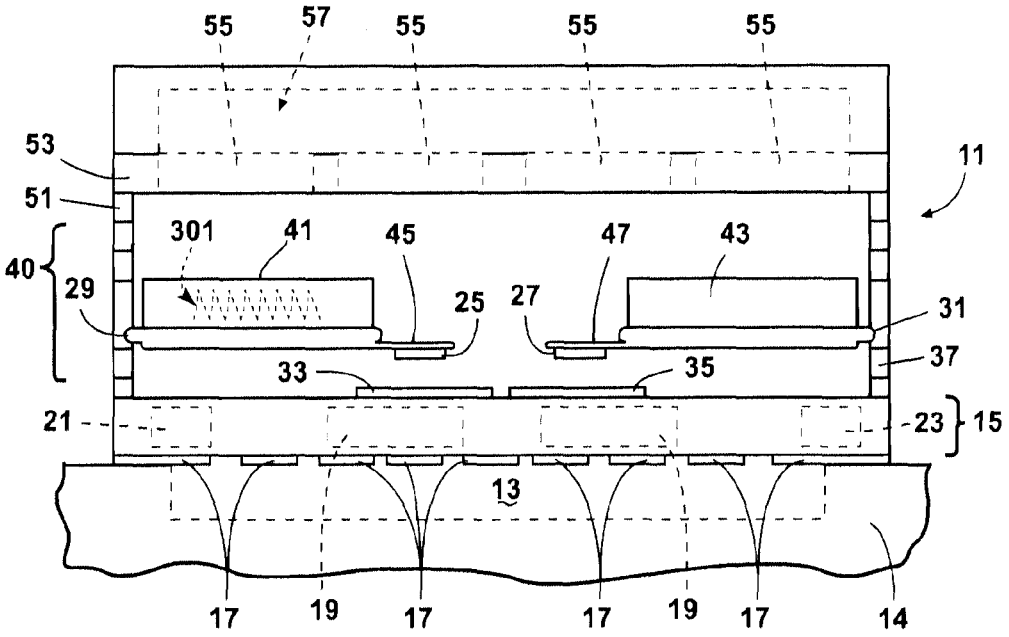
FIG. 1 is a side schematic side view of a switching device structure according to an illustrative embodiment.

A TEMS switching device structure 11 according to an illustrative embodiment is shown schematically in FIG. 1. As shown in the top view of FIG. 2, the device 11 may include two rows of four switches or relays $R_1$, $R_2$, $R_3$, $R_4$, $R_5$, $R_6$, $R_7$, $R_8$, totaling eight switches in all. Various other layouts of varying numbers of switches or relays are of course possible, depending on the application.

The device structure 11 of the illustrative embodiment shown in FIG. 1 includes a bottom magnet 13 which resides in a well in a circuit card 14 to which the TEMS device 11 is mounted. Above the bottom magnet 13 is a base subassembly 15, which consists of a number of layers laminated together. The bottom most of these layers mounts electrical contacts 17, which connect the device 11 to electrical conductors on the circuit card 14. Another of the layers of the base subassembly 15 comprises a number of drilled out cylinders and two routed-out end strips, which are filled with an iron epoxy mix to form iron posts, e.g. 19, and iron strips 21, 23. These posts 19 and strips 21, 23 serve to channel the magnetic force of the bottom magnet 13 toward respective armature flappers 45, 47 and armature rear ends 29, 31.

The top layer of the base subassembly 15 carries respective electrically conductive flapper landing pads 33, 35. Above the base subassembly 15 is a first "ring frame" layer 37, which, in an illustrative embodiment, is a polyglass spacer with a rectangular cutout exposing each of the eight (8) switches $R_1$, $R_2$, $R_3$, $R_4$, $R_5$, $R_6$, $R_7$, $R_8$.

Above the first ring frame layer 37 is an armature subassembly 40, which may, for example, in an illustrative embodiment, comprise eleven (11) layers laminated together, as discussed in more detail below. The layers of the armature subassembly 40 are processed to form electromagnets, e.g. 41, 43 having iron cores with inner and outer conductive windings. The electromagnets 41, 43 are disposed on the respective flappers 45, 47, which carry respective electrical contacts 25, 27. A second ring frame spacer 51 is added on top of the armature subassembly 40.

Figure 2:
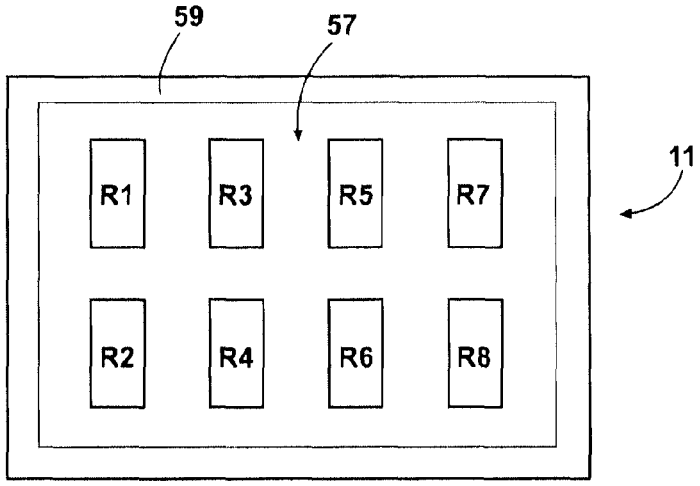
FIG. 2 is a top schematic view of one embodiment of an array of switches constructed according to FIG. 1.

An iron post layer 53 is applied on top of the second ring frame spacer 51. The post layer 53 comprises, for example, sixteen (16) iron epoxy-filled cylinders forming iron posts 55, which channel the magnetic force of a rectangular top magnet 57 to the respective armature flappers 45, 47 and front and rear end 29,31. The top magnet 57 may be mounted within a top magnet frame 59 (FIG. 2).

The top and bottom magnets 13, 57, may be, for example, Neodymium magnets formed of Neodymium alloy $Nd_2Fe_{14}B$, which is nickel plated for corrosion protection. NdFeB is a "hard" magnetic material, i.e., a permanent magnet. In one embodiment, the top magnet may be 375×420×90 mils, and the bottom magnet may be 255×415×110 mils.

In illustrative operation of the device 11, a positive pulse to the armature 41 pulls the armature flapper 45, down, creating an electrical connection or signal path between flapper contact 25 and the landing pad or contact 33. The contacts 25 and 33 are thereafter maintained in a "closed" state by the bottom magnet 13. Thereafter, a negative pulse to the armature 41 repels the flapper 45 away from the bottom magnet 13 and attracts it to the top magnet 57, which holds the flapper 45 in the open position after the negative pulse has passed. In one embodiment, the driver pulse may be, for example, 3 amps at 5 milliseconds.

Figure 3:
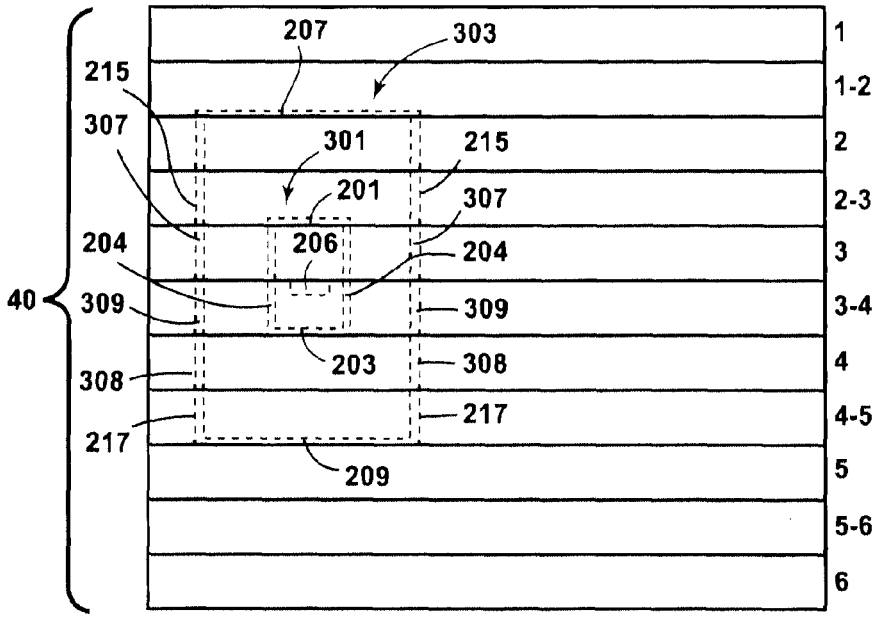
FIG. 3 is a side schematic side view illustrating the positioning of the layers of an illustrative embodiment of an armature assembly.

FIG. 3 illustrates the positioning of the eleven structural layers 1, 1-2, 2, 2-3, 3, 3-4, 4, 4-5, 5, 5-6, 6 of an illustrative armature assembly 40. Each of these layers is, in general, formed of an insulator such as polyamide glass with, for example, copper, tin or other suitable electrical conductor materials. FIG. 3 schematically illustrates an inner or "first" conductive coil or winding 301 and an outer conductive coil or winding 303 formed of suitable conductor patterns and vias as described below in more detail. In one embodiment, polyamide glass substrates plated with copper layers may be patterned with photo resist and etched to create the desired contact and/or conductor patterns, e.g. 201, 203, 207, 209 of the armature subassembly layers. Vias, e.g. 204, 215, 217, 307, 308, 309, may be fabricated in the layers using known techniques.

Figure 4:
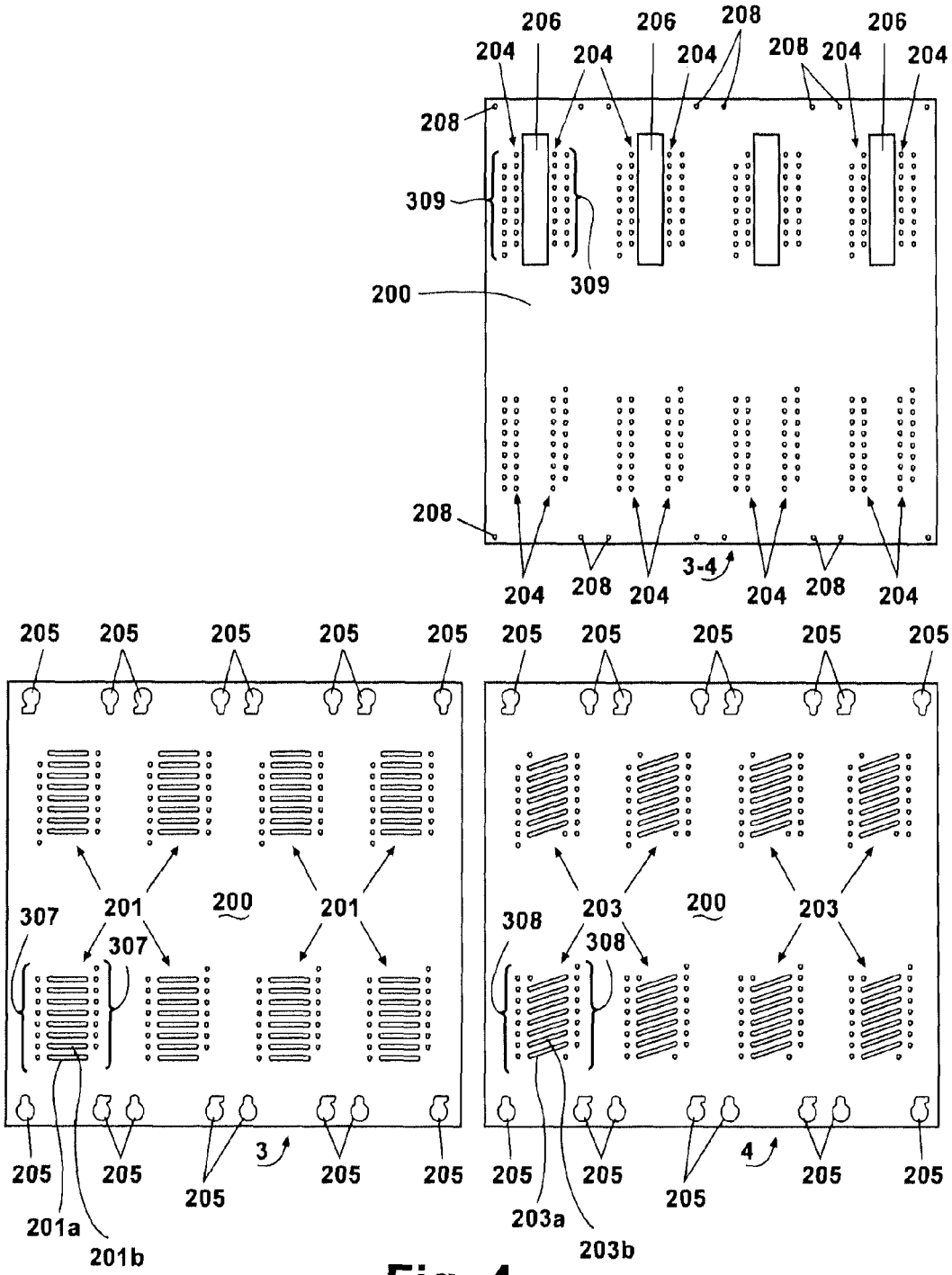
FIG. 4 illustrates three of the armature assembly layers in more detail.

FIG. 4 illustrates three of the armature subassembly layers 3, 4 and 3-4. Layers 3 and 4 each include eight armature winding conductor patterns, 201, 203 formed on respective insulating substrates 200 and eight vias 205 positioned along their respective top and bottom edges. As will be appreciated, one of the conductor patterns 201, 203 is associated with a respective one of the eight switches R1, R2, R3, R4, R5, R6, R7, R8, shown in FIG. 2. Each conductor pattern 201, 203 respectively comprises individual separate conductor traces, e.g., 201*a*, 201*b*, and 203*a*, 203*b*. It will be appreciated that the traces 201*a*, 201*b* are formed on layer 3, which is positioned above the layer 4 on which the traces 203*a*, 203*b* are formed. Hence, traces 201*a*, 201*b* may be viewed as being formed on an upper layer, while traces 203*a*, 203*b* may be viewed as being formed on a lower layer of the illustrated armature assembly 40.

Layer 3-4 of FIG. 4 is positioned between layers 3 and 4 and contains eight pairs of via rows, e.g. 204, each via of which is positioned to appropriately connect with the armature winding conductor patterns 201, 203. Rectangular cavities 206 are routed out of layer 3-4 between the vias 204 and filled with material to form the cores of the armatures' electromagnets e.g. 41, 43. In the illustrative embodiment, an iron powder epoxy mix is used to form iron electromagnet cores. Vias, e.g. 208, are also established along the top and bottom edges of the layer 3-4 substrate. To assist in forming the outer conductive coil 303, respective rows of vias e.g. 307 are also formed on opposite sides of each conductor pattern 201, respective rows of vias 308 are formed on opposite sides of each conductor pattern 203, and respective outer rows of vias 309 are formed on layer 3-4. Then, layers 3 and 4 are laminated to opposite sides of layer 3-4 to form the inner conductive coil or winding 301 of the armatures' electromagnets, e.g. 41, 43. In the resulting structure of coil 301, the conductor pattern 201 of structural layer 3 constitutes a first portion of the coil 301, the vias 204 of layer 3-4 constitute a second portion of the coil 301, and the conductor pattern 203 of layer 4 constitutes a third portion of the coil 301. Thus, each of the plurality of structural layers 3, 3-4 and 4 comprise or include a portion of the coil 301.

Figure 5:
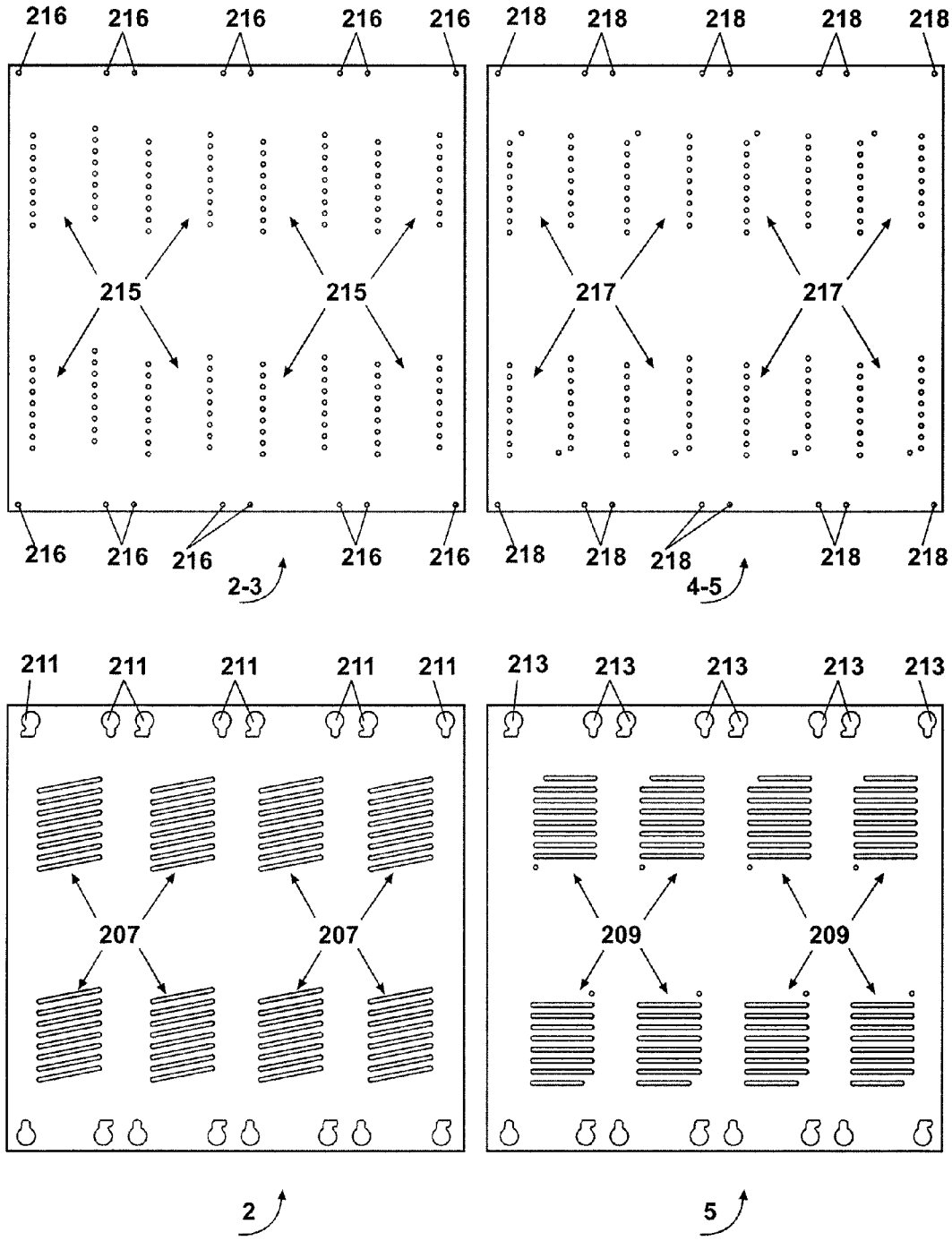
FIG. 5 illustrates four more of the armature assembly layers in more detail.

FIG. 5 illustrates four more of the armature layers: 2, 2-3, 4-5, and 5, Layers 2 and 5 each include eight armature winding conductor patterns 207, 209 and eight vias 211, 213 along their respective top and bottom edges. Layers 2-3 and 4-5 again contain eight respective via pairs 215, 217 positioned to appropriately connect and facilitate current flow through the armature winding conductor patterns 207, 209. Suitable vias, e.g. 216, 218 are established along the respective top and bottom edges of the layer 2-3 and 4-5 substrates.

To further construct the armature, the armature layer 2-3 is laminated to layer 3 of FIG. 4, and layer 4-5 is laminated to layer 4 of FIG. 4, thereby forming the connections for the armature outer windings. Next, layer 2 is laminated to layer 2-3 and layer 5 is laminated to layer 4-5 to complete the outer or "second" conductive coil or winding 303 of the armatures' electromagnets, e.g. 41, 43. Those skilled in the art will appreciate that structural layers 2 and 2-3 comprise a second plurality of structural layers laminated to a first side of the first plurality of structural layers 3, 3-4 and 4, and that structural layers 4 and 4-5 comprise a third plurality of structural layers laminated to an opposite side of the first plurality of structural layers 3, 3-4 and 4.

Figure 6:
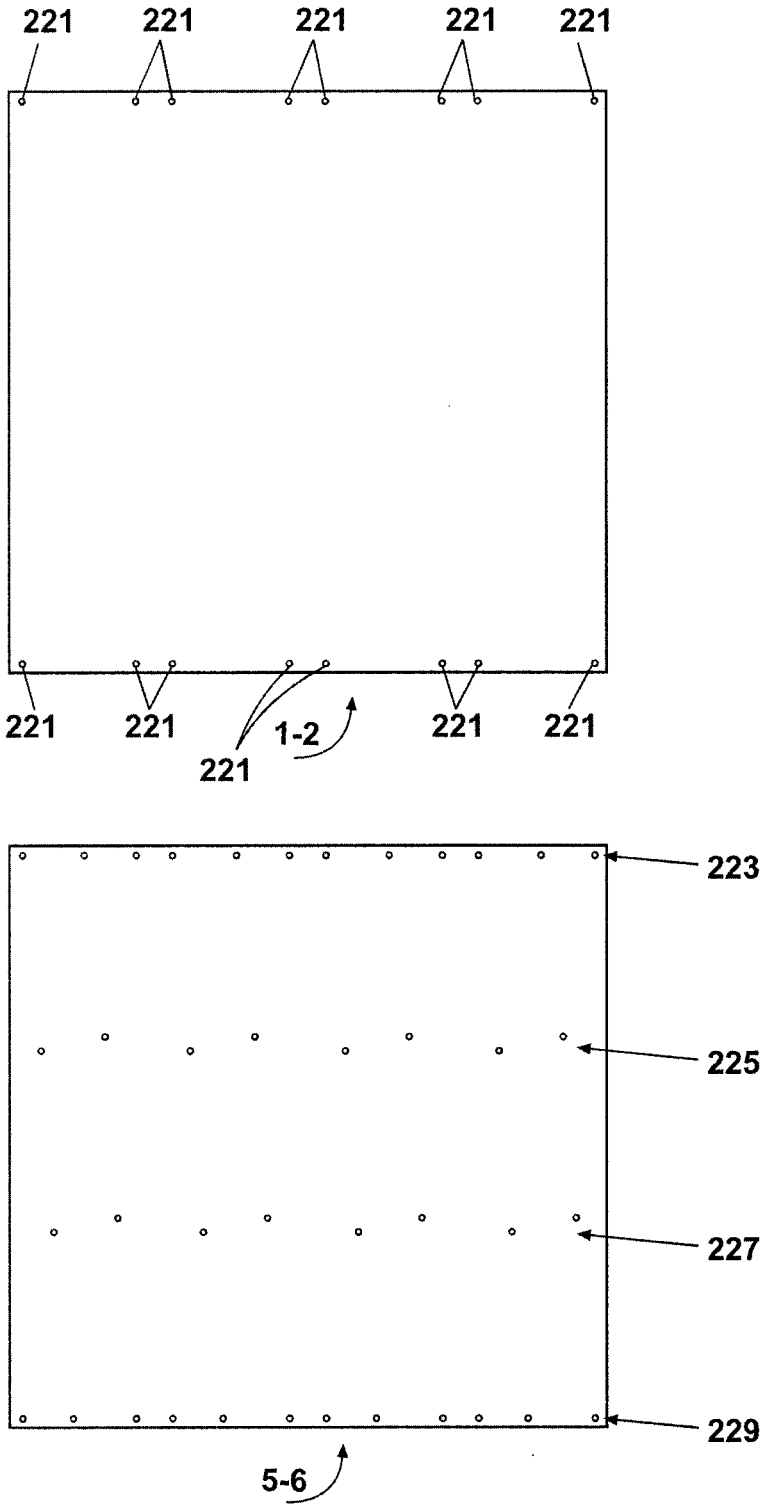
FIG. 6 illustrates two more of the armature assembly layers in more detail.

The next two layers, 1-2 and 5-6, of the armature subassembly 40 are illustrated in FIG. 6. Layer 1-2 has vias 221 on its respective top and bottom edges, while layer 5-6 has four rows of vias 223, 225, 227, 229 for establishing appropriate interconnections with layers on top and bottom of these respective layers 1-2, 5-6. The layer 5-6 center vias 225, 227 connect to the tip/ring pads 235 of layer 6 (FIG. 8) while the edge vias 223, 229 connect to the armature coil up/down driver signal paths 231 of layer 6. Layer 5-6 is laminated to layer 5, and layer 1-2 is laminated to layer 2.

Figure 7:
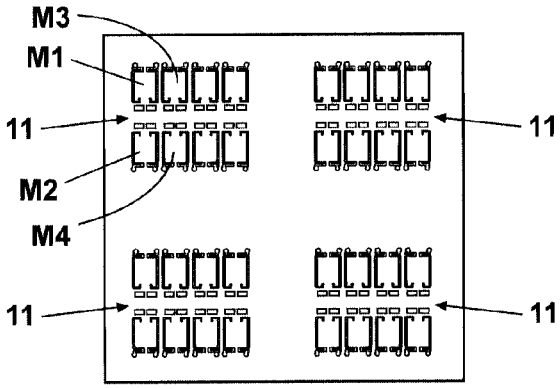
FIG. 7 illustrates a top view of a plurality of electromagnet assemblies according to an illustrative embodiment.

At this point in fabrication of the illustrative armature subassembly 40, the armature electromagnet assemblies are pre-routed, outlining individual electromagnets e.g. M1, M2, M3, M4, as shown in FIG. 7, each held together to the next within the panel by small tabs, e.g., 239, that are removed with final subsequent laser routing. FIG. 7 illustrates fabrication of four separate devices 11 on a common panel.

Figure 8:
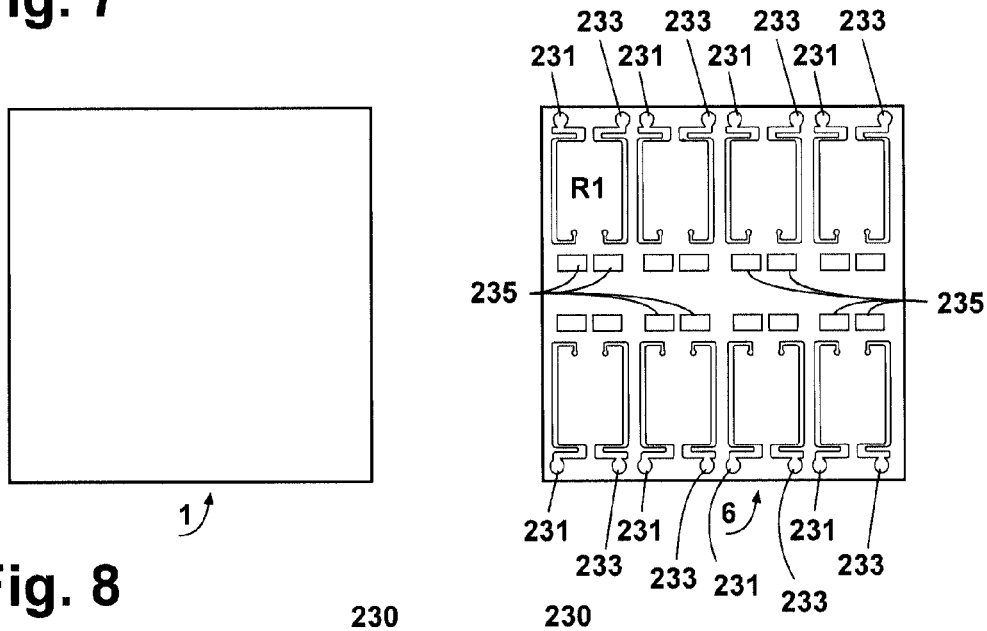
FIG. 8 illustrates the final two layers of the armature assembly in more detail.

The final two layers 1, 6 of the armature subassembly 40 are shown in FIG. 8. After the pre-routing mentioned above, these layers 6, 1 are respectively laminated to layers 5-6 and 1-2 to complete the armature assembly. Layer 6 includes armature-in and armature-out conductors 231, 233 and flapper contact pads 235, which serve to short the tip and ring contacts, as discussed below. Layer 1 is simply a cover layer.

Figure 9:
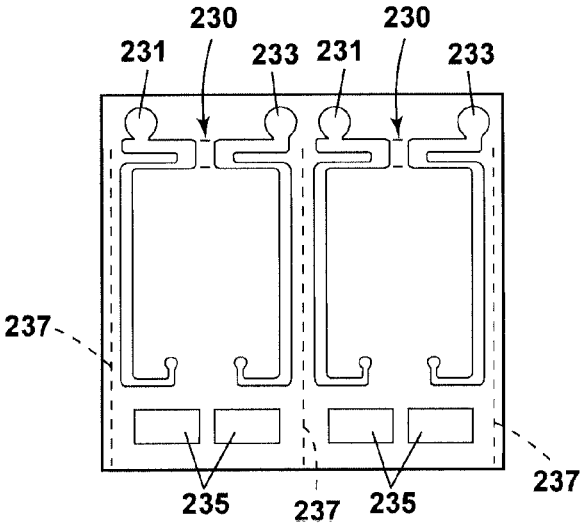
FIG. 9 is an enlarged view illustrating routing employed to create flexures or flappers according to the illustrative embodiment.

After the lamination of the last two layers 2, 6, the electrical contacts, e.g. 25, 27 (FIG. 1) are formed on the armature flappers. The contacts 25, 27 may be formed of various conductive materials, such as, for example, gold, nickel copper, or diamond particles. After contact formation, the armatures are laser routed to free the armatures for up and down movement held in place by their two flexures. Routing is done outside of the conductor lines as shown by dashed lines 237 in FIG. 9. As a result, an armature coil is positioned within each of the flexure lines 237. After these steps, the armature subassembly is attached to the lower ring frame layer 37 by laminating layer 6 to the ring frame layer 37.

Figure 12:
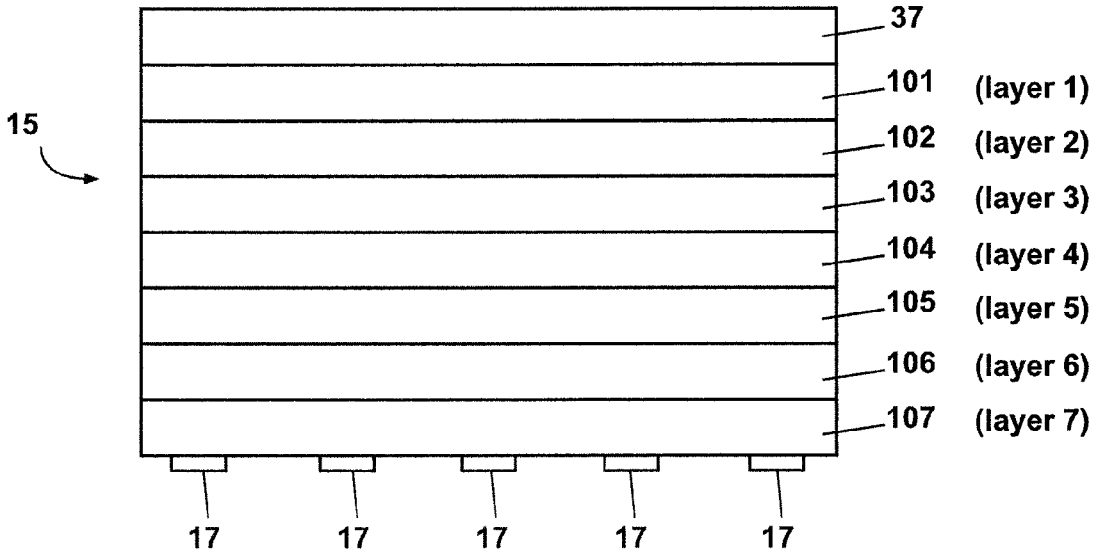
FIG. 12 is a schematic side view illustrating the positioning of the layers of an illustrative base subassembly embodiment.

In one illustrative embodiment, the base subassembly 15 comprises a stack of layers 101, 102, 103, 104, 105, 106, and 107, laminated together, as shown schematically in FIG. 12. Lamination of the base subassembly 15 and other layers may be done by a suitable adhesive such as "Expandex" or other well-known methods.

Figure 13:
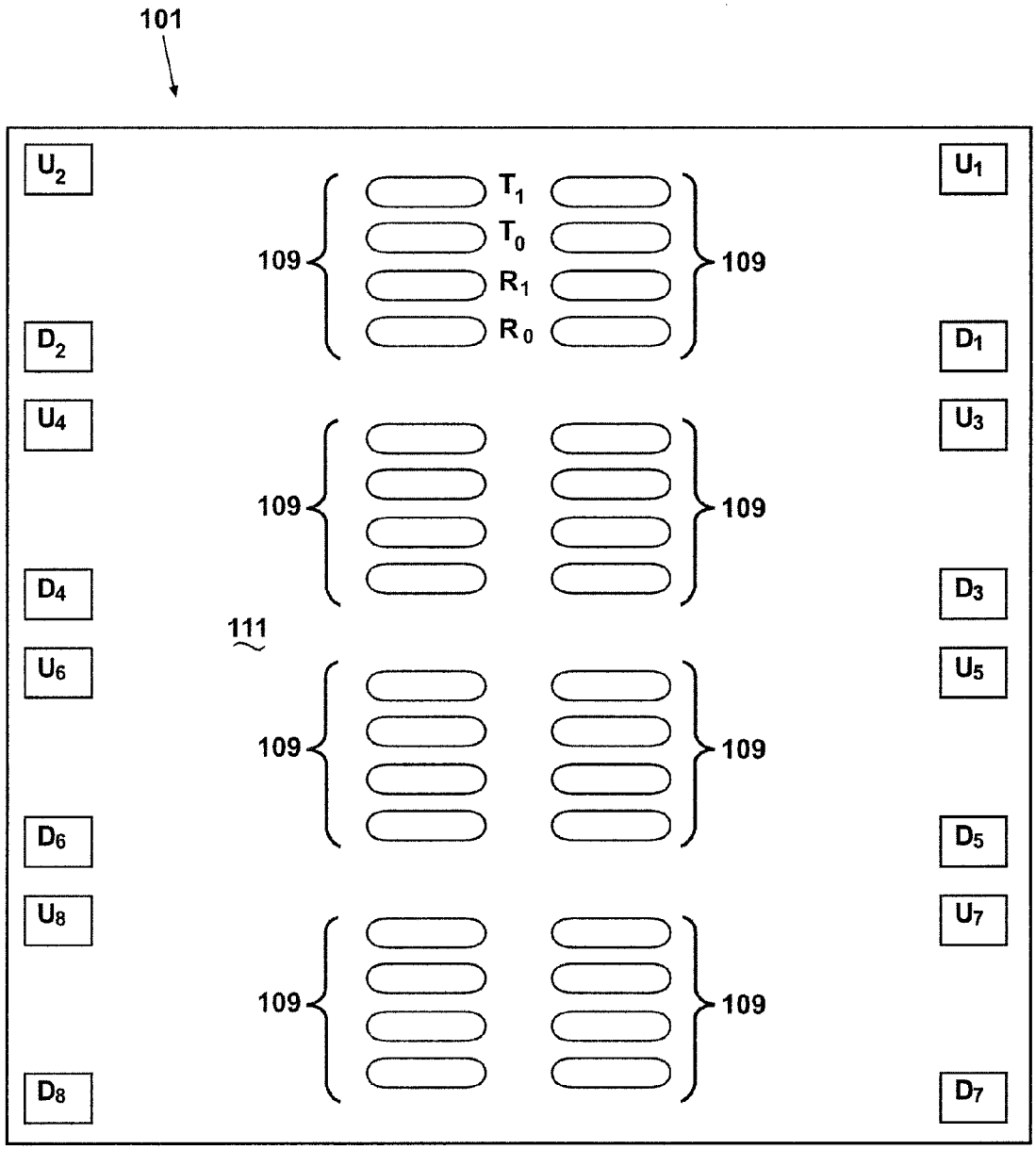
FIG. 13 is an enlarged view of the top layer of the base subassembly of FIG. 12.

An illustrative top layer 101 of the base subassembly 15 of an individual 2×4 switch matrix as shown in FIG. 2 is illustrated in FIG. 13. This layer contains eight sets of four electrical contacts disposed in a central region 111 of the layer. In the illustrative embodiment, each set 109 contains a "tip-in" contact, and an adjacent "tip-out" contact, as well as a "ring-in" contact and an adjacent "ring-out" contact. For example, the first set 109 of four electrical contacts contains tip-in and tip-out contacts $T_{1i}$, $T_{10}$ and ring-in and ring-out contacts $R_{1i}$, $R_{10}$. When a particular relay is activated, one of the flapper contact pads 235 shorts across the $T_i$, $T_O$ contacts, while the adjacent flapper pad 235 shorts across the $R_i$, $R_O$ contacts.

Along the top and bottom edges of the layer 101 are arranged conductor paths or "vias" through the layer for supplying drive pulses to the armature coils, e.g. 41, 43 formed above the layer 101. For example, "up" conductor $U_1$ supplies input current to the coil of a first armature coil, while "down" conductor $D_1$ conducts drive current out of the first armature coil. Similarly, $U_3$, $D_3$; $U_5$, $D_5$; $U_7$, $D_7$; $U_8$, $D_2$; $U_4$, $D_4$; $U_6$, $D_6$; and $U_8$, $D_8$ supply respective "up" and "down" currents to each of the respective seven other armature coils.

Top base subassembly layer 101 may be formed in one embodiment of an insulator such as polyamide glass with, for example, copper, tin or other suitable electrical conductor materials. Polyamide glass substrates plated with plated copper layers may be patterned with photo resist and etched to created the desired contact and/or conductor patterns of the base subassembly layers. The other layers of the device 11 may be similarly fabricated.

Figure 14:
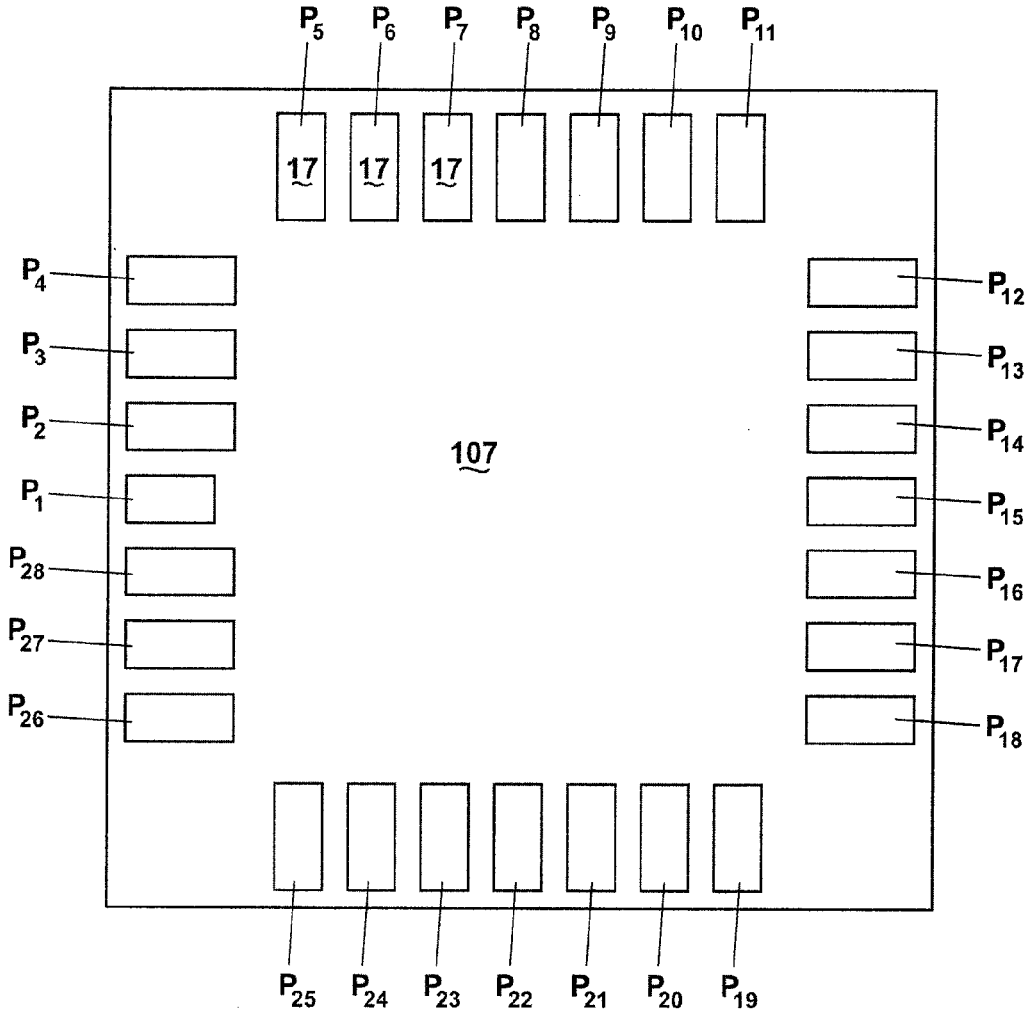
FIG. 14 illustrates the bottom layer of the base subassembly of FIG. 12.

The remainder of the base subassembly 15 is concerned with routing signals from the tip and ring pads, e.g. $T_{1i}$, $T_{1o}$, $R_{1i}$, $R_{1o}$, through the device to the exterior contacts 17 of the bottom base subassembly layer 107 and routing drive current to and from the armature supply conduits, $U_1$, $D_1$; $U_2$, $D_2$; $U_3$, $D_3$, etc. FIG. 14 illustrates the bottom bases subassembly layer 107 and the pin assignments of contacts 17 in more detail, to assist in illustrating the signal routing through the base subassembly 15 of the illustrative embodiment.

The pad assignments for the embodiment shown in FIG. 14 are as follows:

| Pad Signals Assignments Table | |
|---|---|
| $P_1$ | $C_0$ Ring - in |
| $P_2$ | Common (coil control) |
| $P_3$ | Coil 1 Input |
| $P_4$ | $C_0$ Tip - in |
| $P_5$ | Tip - out O |
| $P_6$ | Ring - out O |
| $P_7$ | Coil 3 input |
| $P_8$ | Common |
| $P_9$ | Tip out 2 |
| $P_{10}$ | Coil 5 input |
| $P_{11}$ | Ring - out 2 |
| $P_{12}$ | Common |
| $P_{13}$ | Coil 7 input |
| $P_{14}$ | Common |
| $P_{15}$ | C1 Tip - in |
| $P_{16}$ | Common |
| $P_{17}$ | Coil 8 input |
| $P_{18}$ | C1 Ring - in |
| $P_{19}$ | Ring out 3 |
| $P_{20}$ | Tip - out 3 |

-continued

| Pad Signals Assignments Table | |
|---|---|
| $P_{21}$ | Coil 6 input |
| $P_{22}$ | Common |
| $P_{23}$ | Ring - out 1 |
| $P_{24}$ | Coil 4 input |
| $P_{25}$ | Tip out 1 |
| $P_{26}$ | Common |
| $P_{27}$ | Coil 2 input |
| $P_{28}$ | Common |

Figure 15:
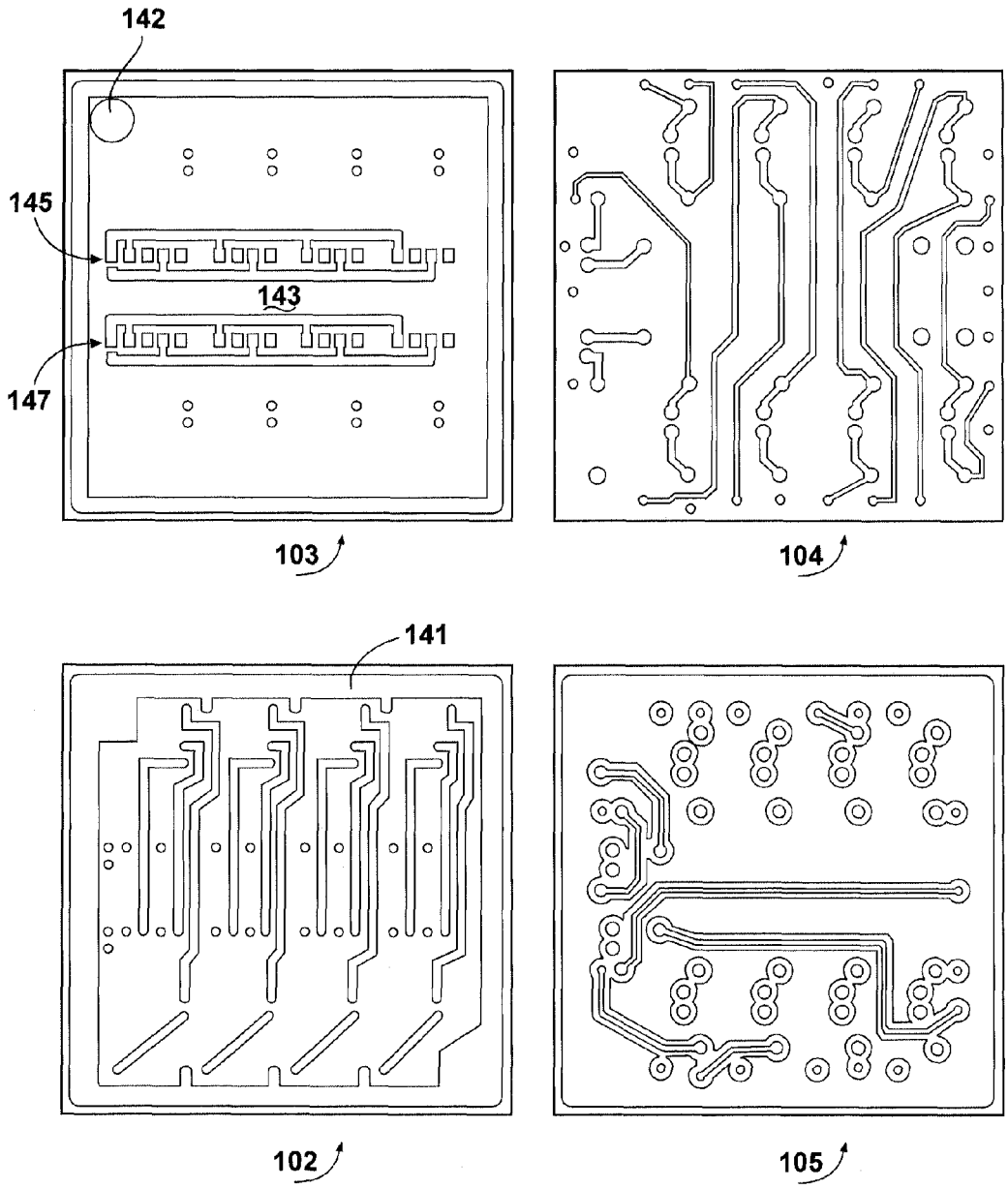
FIG. 15 illustrates four intermediate layers of the base subassembly of FIG. 12.

It will be appreciated from the pin assignments that all of the "down" armature coil supply conduits D1, D2, D3, D4, D5, D6, D7, D8 are connected in common. In this connection, the layer 102 includes a metallization border 141 forming a common ground plane for the armatures. Layer 103 (FIG. 15) includes a post 142 which connects the common plane to pin 2. Layer 105 includes traces and vias to the pin outs on layer 7.

Additionally, it will be seen from the pad assignments in the Table above that there is one pair of tip and ring conductor outputs for relays R1 and R2, one pair for R3 and R4, one pair for R5 and R6, and one pair for R7 and R8. There are also two pairs of tip and ring inputs (C0 Ring—in, C0 Tip—in, C1 Tip—in, C1 Ring—in). Thus, in the illustrative embodiment, only two of the relays of the 2×4 matrix (one odd, one even) may be closed at the same time. The metallization pattern of layer 103 reflects this tip and ring interconnection scheme. In particular, the central metallization 143 comprises two rows 145, 147 wherein the top row 145 provides tip and ring interconnections for the row "1" tip and ring inputs and the bottom row 147 provides the tip and ring interconnections for the row "2" tip and ring inputs, thus illustrating how the tips and rings are connected in common. The manner of interconnection is such that connecting opposite row 1 and row 2 switches, e.g. R1 and R2 in FIG. 2, creates a short. In one illustrative embodiment, software control prevents such shorts.

Figure 16:
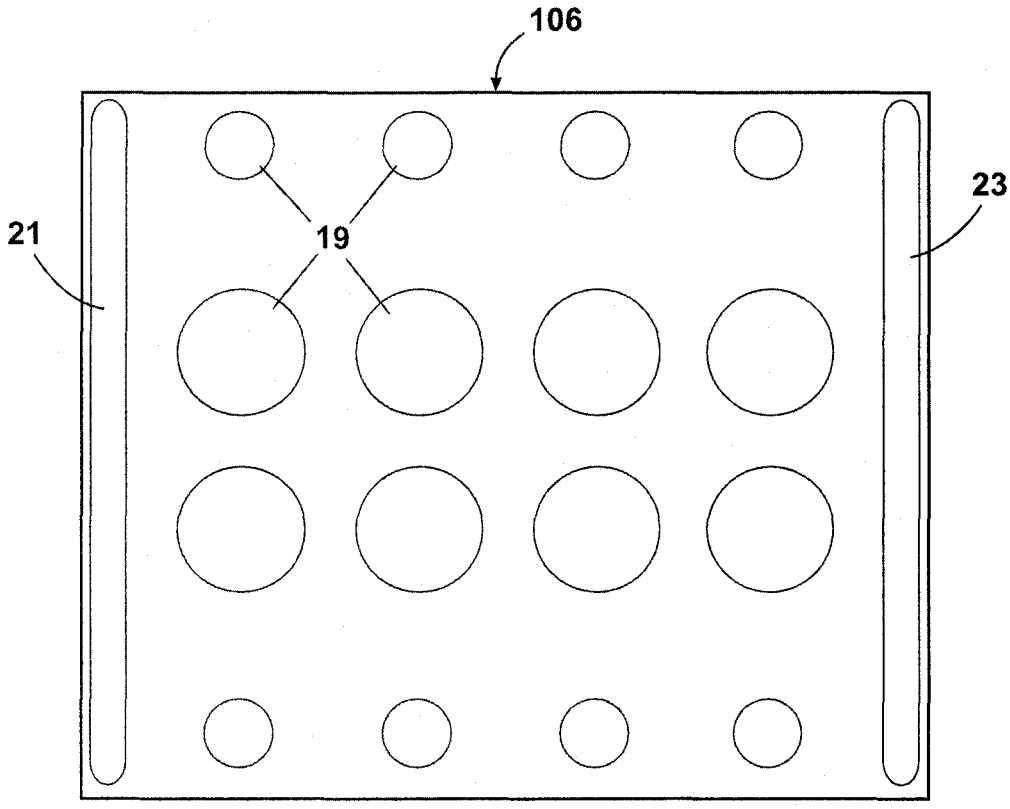
FIG. 16 illustrates the iron post layer of the base subassembly of FIG. 12.

The iron post layer 106 of the base subassembly is further illustrated in FIG. 16. As shown, eight large and eight small cylinders are drilled and two end strips are routed out of layer 106 and are filled with an iron powder epoxy mix to form the iron posts 19 and iron strips 21, 23 that channel the magnetic force of the bottom magnet 13 toward the armatures' flappers 25, 27 and the armature rear ends 29, 31. Suitable vias (not shown) are formed in layer 106 to transmit signals between the layers 105 and 107. Thereafter, the layer 106 is laminated between layers 105 and 107 to complete the base subassembly. In one embodiment, layer 106 may be, for example, 16 mils thick, while the large and small cylinders are 64 mils and 30 mils in diameter respectively. Layers 102, 103, 104, 105 may be, for example, 2 to 3 mils thick. The lower ring frame layer 37 is laminated to the first base subassembly layer 101.

Figure 10:
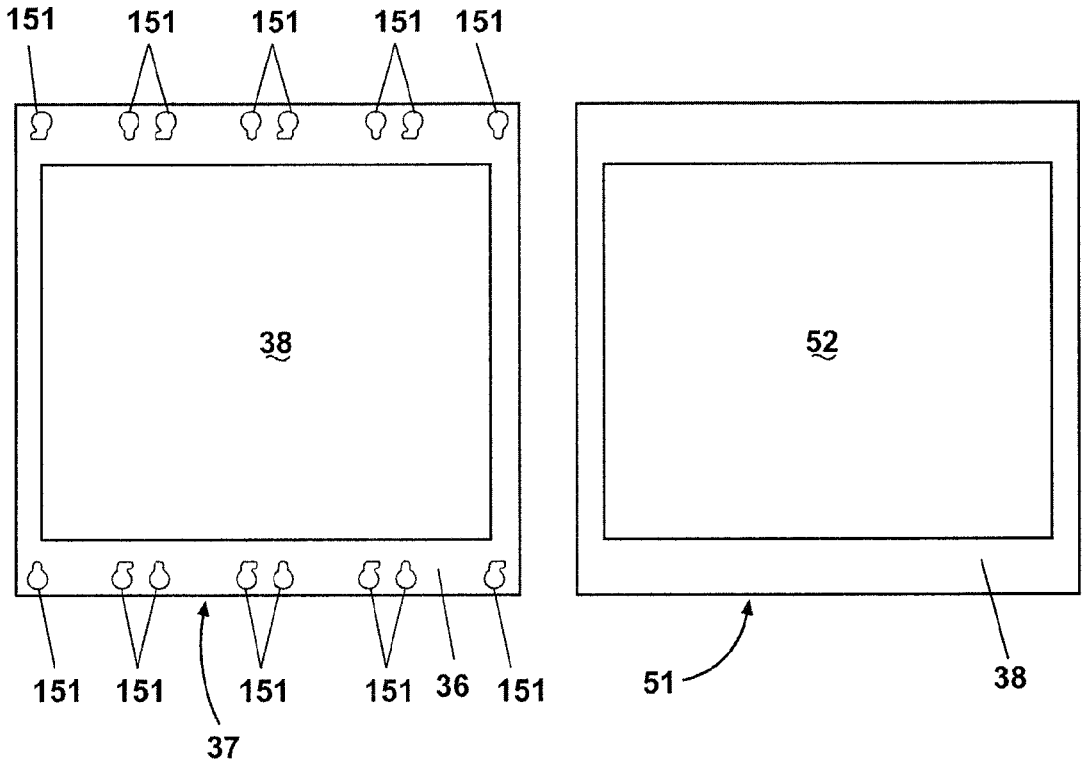
FIG. 10 illustrates the two ring frames of FIG. 1 in more detail.

The upper and lower ring frames 37, 51 are further illustrated in FIG. 10. In one embodiment, they are 8 and 5 mils thick respectively. The lower ring frame 37 has appropriate vias 151 for conducting the armature drive signals, while the upper ring frame 51 has no vias. The rectangular space 38, 52, within each of the borders 36, 38 of the respective frames 37, 51 are hollow.

Figure 11:
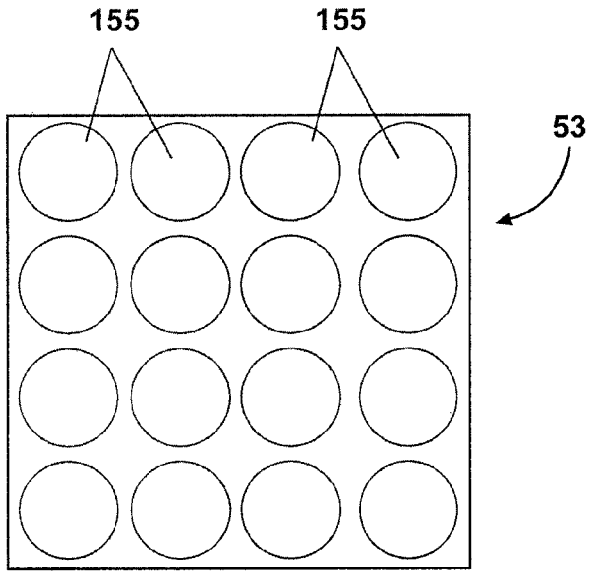
FIG. 11 illustrates the top iron post layer of FIG. 1 in more detail.

The upper iron post layer 53 is illustrated further detail in FIG. 11. It comprises 16 small cylinders, e.g. 155, drilled and filled with an iron powder epoxy mix to form iron posts that channel the magnetic force of the top magnet 57 toward the armature subassembly 40.

Those skilled in the art will appreciate that various adaptations and modifications of the just described preferred embodiment can be configured without departing from the scope and spirit of the invention. Therefore, it is to be understood that, within the scope of the appended claims, the invention may be practiced other than as specifically described herein.

What is claimed is:

1. In a switching device or relay, the structure comprising:
a first plurality of structural layers laminated together;
a first conductive coil formed within the first plurality of laminated-together structural layers, each of the plurality of structural layers including a portion of said first conductive coil;
wherein said structural layers comprise a first layer wherein first and second rows of vias are formed in a non-conductive portion of said first layer; and
wherein said structural layers further comprise a second layer and a third layer attached to respective top and bottom sides of said first layer and each comprising a respective conductor pattern, the respective conductor patterns interconnecting said vias so as to complete said first conductive coil.

2. The switching device or relay of claim 1 further comprising a base structure formed of a plurality of laminated layers beneath said coil and having conductive paths formed therethrough and connected to supply drive current to said coil.

3. The switching device or relay of claim 1 further comprising a second plurality of structural layers laminated to a first side of said first plurality of structural layers and a third plurality of structural layers laminated to an opposite side of said first plurality of structural layers wherein said first, second, and third plurality of structural layers comprise a second conductive coil.

4. The switching device or relay of claim 3 wherein said first conductive coil comprises an inner conductive coil and said second conductive coil comprises an outer conductive coil.

5. The switching device or relay of claim 1 where said conductive coil or winding is formed on a moveable member.

6. The structure of claim 1 wherein each of said structural layers lies in a horizontal plane and wherein said first conductive coil is configured to generate a horizontally directed magnetic field.

7. In a switching device or relay, the structure comprising:
a first plurality of structural layers laminated together; and
a first conductive coil formed within the first plurality of laminated-together structural layers, each of the plurality of structural layers comprising a section of said first conductive coil;
wherein first and second rows of vias are formed in a non-conductive portion of one of said structural layers; and
wherein said structural layers further comprise a second layer and a third layer attached to respective top and bottom sides of said one layer and each comprising a respective conductor pattern, the respective conductor patterns interconnecting said vias so as to complete said first conductive coil.

8. The switching device or relay of claim 7 where said conductive coil or winding is formed on a moveable member.

9. The switching device or relay of claim 7 wherein the first and second rows of vias are the only portions of said first conductive coil formed in or on said one of said structural layers.

10. The structure of claim 7 wherein each of said structural layers lies in a horizontal plane and wherein said first conductive coil is configured to generate a horizontally directed magnetic field.

11. In switching device or relay, the structure comprising:
a plurality of separate first conductor segments formed on an upper layer;
a plurality of separate second conductor segments formed on a lower layer; and
one or more layers positioned between said upper and lower layers, each of the one or more layers containing a first set of vias and a second set of vias configured to connect respective ends of a plurality of said first conductor segments with respective ends of said first and second conductor segments so as to form an electrically conductive coil or winding.

12. The switching device or relay of claim 11 where said conductive coil or winding is formed on a moveable member.

13. The structure of claim 11 wherein said upper layer, lower layer and one or more said layers each lie in a horizontal plane and wherein said electrically conductive coil or winding is configured to generate a horizontally directed magnetic field.

14. In a switching device or relay, the structure comprising:
a first plurality of structural layers laminated together;
a first conductive coil formed within the first plurality of laminated-together structural layers;
wherein said structural layers comprise a first layer wherein first and second rows of vias are formed in a non-conductive portion of said first layer;
wherein said structural layers further comprise a second layer and a third layer attached to respective top and bottom sides of said first layer and each comprising a respective conductor pattern, the respective conductor patterns interconnecting said vias so as to complete said first conductive coil; and
wherein said structural layers further comprise a second plurality of structural layers laminated to a first side of said first plurality of structural layers and a third plurality of structural layers laminated to an opposite side of said first plurality of structural layers wherein said first, second, and third plurality of structural layers comprise a second conductive coil.

15. The switching device or relay of claim 14 further comprising a base structure formed of a plurality of laminated layers beneath said first and second conductive coils and having conductive paths formed therethrough and connected to supply drive current to said first and second conductive coils.

16. The switching device or relay of claim 14 wherein said first conductive coil comprises an inner conductive coil and said second conductive coil comprises an outer conductive coil, the inner conductive coil lying entirely within the outer conductive coil.

17. The structure of claim 14 wherein each of said structural layers lies in a horizontal plane and wherein said first conductive coil is configured to generate a horizontally directed magnetic field.

18. A switching device or relay structure comprising:
a top magnet;
a bottom magnet;
a cavity between said top and bottom magnets;
a moveable member attached to a sidewall of said cavity and disposed between said top and bottom magnets and having a first electrically conductive coil or winding positioned thereon;

the first electrically conductive coil or winding comprising:

a plurality of laminated layers;

a plurality of separate first conductor segments formed on an upper layer of said laminated layers;

a plurality of separate second conductor segments formed on a lower layer of said laminated layers; and one or more layers of said laminated layers being positioned between said upper and lower layers, each of the one or more layers containing a set of vias configured to connect respective ends of said first and second conductor segments so as to form said electrically conductive coil or winding, said one or more layers containing no other portion of said electrically conductive coil or winding.

19. The structure of claim 18 further comprising a second plurality of structural layers laminated to a first side of said first plurality of structural layers and a third plurality of structural layers laminated to an opposite side of said first plurality of structural layers wherein said first, second, and third plurality of structural layers comprise a second electrically conductive coil or winding.

20. The structure of claim 19 wherein said first electrically conductive coil or winding comprises an inner conductive coil or winding and wherein the second electrically conductive coil or winding comprising an outer conductive coil or winding having an interior, said inner conductive coil or winding lying entirely within the interior of said outer conductive coil or winding.

21. The structure of claim 18 wherein said moveable member further comprises coil-in and coil-out conductors for conducting current to and from said electrically conductive coil or winding.

22. The structure of claim 18 wherein each of said structural layers lies in a horizontal plane and wherein said electrically conductive coil or winding is configured to generate a horizontally directed magnetic field.

23. A switching device or relay structure comprising:

a top magnet;

a bottom magnet;

a cavity between said top and bottom magnets;

a moveable member attached to a sidewall of said cavity and disposed between said top and bottom magnets and having an electrically conductive coil or winding positioned thereon;

the electrically conductive coil or winding comprising:

a first plurality of structural layers laminated together;

wherein said structural layers further comprise an upper layer and a lower layer each comprising a respective conductor pattern; and one or more structural layers located between said upper layer and said lower layer, each of said one or more structural layers including a set of vias, the sets of vias being configured to interconnect the respective conductor patterns of said upper and lower layers so as to complete said electrically conductive coil or winding.

* * * * *